US006559077B1

(12) United States Patent
Moore

(10) Patent No.: US 6,559,077 B1
(45) Date of Patent: May 6, 2003

(54) HEAT SHRINK SYNTHETIC MESH STRUCTURE

(75) Inventor: Donal Moore, Birmingham, MI (US)

(73) Assignee: Polytech Netting, L.P., Troy, MI (US)

( * ) Notice: Subject to any disclaimer, the term of this patent is extended or adjusted under 35 U.S.C. 154(b) by 0 days.

(21) Appl. No.: 09/358,079

(22) Filed: Jul. 21, 1999

Related U.S. Application Data

(60) Provisional application No. 60/143,066, filed on Jul. 9, 1999.

(51) Int. Cl.[7] ..... D04H 1/00

(52) U.S. Cl. ..... 442/2; 442/5; 442/49; 442/50; 442/185; 442/305; 442/313; 66/190; 66/192; 66/193; 66/195

(58) Field of Search ..... 442/2, 5, 49, 185, 442/208, 305, 313; 139/11; 66/84 R, 85 R, 190, 192, 193, 195

(56) References Cited

U.S. PATENT DOCUMENTS

| | | | | | |
|---|---|---|---|---|---|
| 3,479,244 | A | * | 11/1969 | Burnett | 161/58 |
| 3,575,777 | A | | 4/1971 | Allport | |
| 4,000,344 | A | | 12/1976 | Dilbey | |
| 4,554,202 | A | * | 11/1985 | Kamei et al. | 428/225 |
| 4,651,620 | A | | 3/1987 | Lyons | |
| 4,671,988 | A | * | 6/1987 | Dowell et al. | 428/226 |
| 4,797,311 | A | * | 1/1989 | Kemp | 428/92 |
| 5,053,269 | A | | 10/1991 | Ducol et al. | 428/253 |
| 5,300,165 | A | | 4/1994 | Sugikawa | 156/150 |
| 5,433,991 | A | | 7/1995 | Boyd, Jr. et al. | |
| 5,772,370 | A | * | 6/1998 | Moore | 410/100 |
| 5,994,242 | A | | 11/1999 | Arthurs | 442/43 |

* cited by examiner

*Primary Examiner*—Elizabeth M. Cole
*Assistant Examiner*—Ula C. Ruddock
(74) *Attorney, Agent, or Firm*—Young & Basile, P.C.

(57) ABSTRACT

A mesh structure is formed from a set of a warp strands and a set of intersecting weft strands. The warp strands are formed of a knitted synthetic material which shrinks when exposed to heat, and the weft strands pass through the weave of the warp strands at the nodes where the strands intersect. Heat is applied to the mesh structure to shrink the weave of the warp strands tightly around the weft strands at the nodes, thereby co-joining the weft and warp strands to form a high-strength mesh.

20 Claims, 1 Drawing Sheet

HEAT SHRINK SYNTHETIC MESH STRUCTURE

CROSS REFERENCE TO RELATED APPLICATIONS

This application claims the benefit of U.S. Provisional Application Ser. No. 60/143,066, filed Jul. 9, 1999.

FIELD OF THE INVENTION

This invention relates to mesh structures such as those used for cargo restraint nets, and to methods for the manufacture of such mesh structures.

BACKGROUND OF THE INVENTION

Cargo restraint nets are used in many different shipping and transportation applications to prevent undesired shifting of cargo. Such netting is typically made from a high strength mesh structure which may be formed from any of numerous suitable materials and processes. Among the materials commonly used for such nets are synthetic fibers, such as coated polyesters, multi-filament polypropylenes, nylons and mixtures thereof, which are formed into elongated members or strands. These strands are then used to create a mesh structure by various methods such as weaving, knitting, rochelle, or weft insertion.

One technique used to form mesh is to knot the warp and weft strands together at their points of intersection. This, however, results in an inherent weakness at the knots due to stress concentrations. In cases where the strands are made of synthetic material, it is also known to bond the warp and weft strands together at the intersections by heat or chemical welding. Welding of synthetic strands can also lead to weakness at the joints.

U.S. Pat. No. 4,000,344 teaches a netting formed by threading each strand through a hole formed in the other strand at the intersection point. After completion of this weaving process, the net may be impregnated with a binding agent to cause the synthetic fibers of each strand to cohere, thereby promoting the non-slip quality of the intersections.

It is known that some types of synthetic materials, such as thermoplastics, shrink when heated to a temperature below the melting temperature of the material.

SUMMARY OF THE INVENTION

In carrying out this invention in the preferred embodiment described and depicted herein, a mesh structure comprises first and second sets of intersecting elongate members, referred to as weft strands and warp strands respectively. The warp strands are knitted or woven from threads formed from synthetic fibers which shrink when heated, and the weft strands pass through the weave of the warp strands at the points of intersection, hereinafter referred to as "nodes." Heat is applied to the mesh structure to shrink the weave of the warp strands tightly around the weft strands at the nodes, thereby co-joining the weft and warp strands to form a high-strength mesh.

In a preferred embodiment of the invention method for producing a synthetic mesh, the mesh is heated by exposing it to the rays of an ultraviolet lamp. The ultraviolet heating can be precisely controlled in both intensity and time of application, so that the warp strands may be heated just enough to achieve the desired amount of shrinkage without melting either the weft or warp strands.

DETAILED DESCRIPTION OF THE PREFERRED EMBODIMENT

Figure 1:
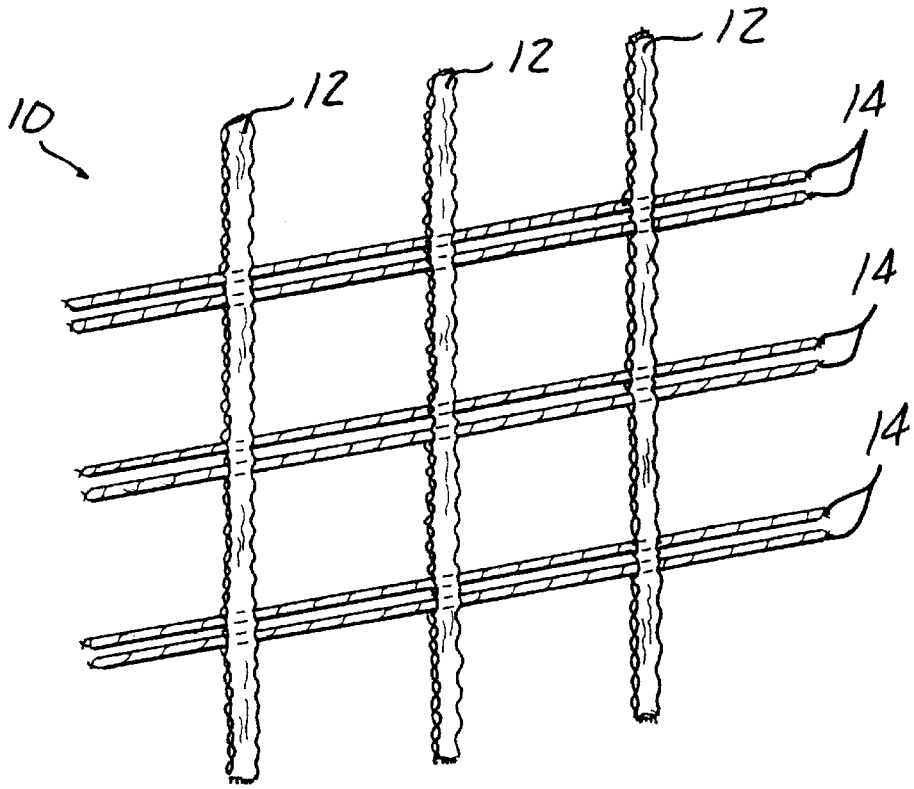
FIG. 1 is a perspective view of a section of a mesh structure according to the present invention.
Figure 2:
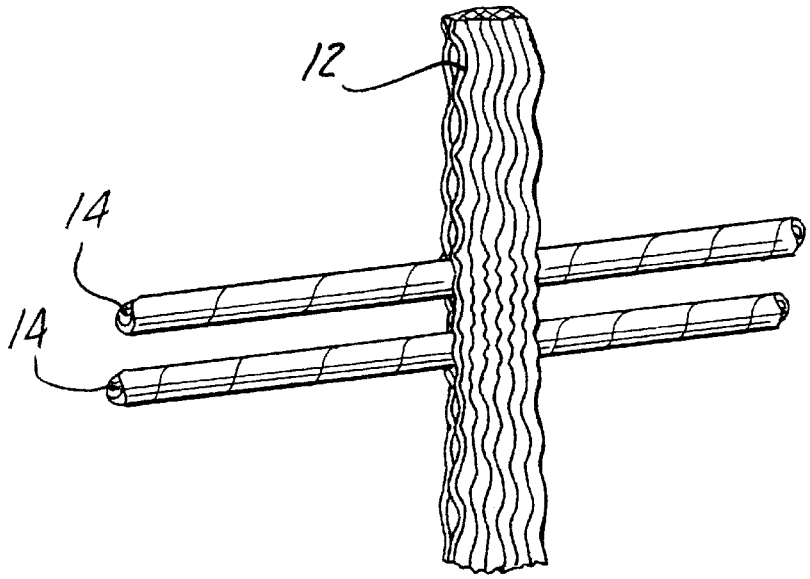
FIG. 2 is a detail view of a node of the mesh structure of FIG. 1.

As seen in FIGS. 1 and 2, a representative section of a mesh structure 10 according to the present invention comprises a plurality of elongated warp strands 12 disposed in a generally parallel arrangement, and a plurality of elongated weft strands 14 oriented generally perpendicular to the warp elements. While FIG. 1 depicts a mesh wherein all of the strands 12,14 are mutually parallel and perpendicular, the present invention is not limited to such a mesh but rather may be practiced with meshes having any pattern of intersecting weft and warp strands.

The warp strands 12 are narrow straps knitted or woven from threads composed of synthetic fibers which shrink when heated to a temperature below the temperature at which it begins to melt. Polypropylene is one example of such a material. The weft strands 14 may be made of any suitable material, but are preferably a twisted twine formed of synthetic fibers such as polypropylene.

The weft strands 14 pass through the weave of the warp strands 12 so that at each node the weft strands are completely surrounded by the threads that make up the weave of the warp strands. This may be achieved by a weft insertion process. The mesh structure 10 is then heated to a temperature below the melting point of the material of the warp strands 12, but sufficiently high to cause the weave of the warp strands to shrink and constrict tightly around the weft strands 14 passing therethrough. This constriction of the warp strands 12 causes them to grip the weft strands 14 tightly so that the weft strands do not slide relative to the warp strands.

The correct temperature and duration of the heating of the warp strands 12 to achieve the desired shrinkage depends upon many factors. Among these factors are the type and denier of the synthetic fibers which make up the threads, and the size and thread density of the strands 12.

The mesh 10 may be heated by any suitable means, such as radiant heat, convection heat, or by ultrasonic waves. In the preferred embodiment, however, the mesh structure 10 is heated by exposing it to the rays of an ultraviolet lamp. It has been found that ultraviolet heating of the mesh may be very precisely controlled in both intensity and time of application so that the warp strands 12 are heated just enough to provide an sufficient shrinkage to co-join the strands but are not overheated to the point where they begin to melt or otherwise negatively affected.

Only the warp strands 12 of the invention mesh structure 10 need to shrink in order to co-join the weft strands 14 and warp strands. Accordingly, it may be desirable to form the warp strands 12 of a first material which shrinks when heated to a given temperature, and form the weft strands 14 of a second material that does not shrink at the given temperature.

It is also possible to achieve differential heating of the weft strands 14 and warp strands 12 by using differently colored materials for the two strands. Specifically, the warp strands 12 may be formed of a relatively dark colored material and the weft strands 14 of a relatively light colored material. When the mesh structure 10 is exposed to a radiant heat source, the darker colored warp strands 12 will heat more quickly than the lighter colored weft strands 14 so that the warp strands 12 reach the temperature at which the desired shrinkage occurs prior to the weft strands 14 reaching the same temperature.

Although it is not necessary to shrink the weft strands 14, heating the mesh to shrink the warp strands 12 may have a beneficial effect on weft strands formed from synthetic fibers. For example, if the weft strands 14 are of a twisted construction, the application of heat may bond or fuse the exterior fibers of each weft strand together, making the exterior of the strand more resistant to abrasion and less likely to fray.

The warp and weft strands may be of any desired size, and they may be spaced from one another to create a mesh of any desired size depending on the intended usage of the mesh. In a preferred embodiment of the invention, the warp strands 12 are approximately 4 mm. wide and 2 mm. thick and are spaced approximately 25 mm. apart. The twisted weft strands 14 are approximately 2 mm. in diameter and are arranged in closely spaced pair relative to the overall mesh size. The weft strands 14 of each pair are spaced approximately 3 mm. apart, and the pairs are approximately 25 mm. apart. This arrangement results in a mesh having generally equal strengths in both the weft-wise and warp-wise directions.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

The invention claimed is:

1. A mesh structure comprising:

at least one warp strand formed of heat shrinkable thread material woven into a weave; and at least one weft strand passing through the weave of the at least one warp strand and immovably associated with the heat shrinkable thread material of the at least one warp stand after application of heat to shrink the thread material of the at least one warp strand into immovable engagement with the at least one weft strand piercingly engaged through the at least one warp stand.

2. The mesh structure of claim 1 wherein the at least one weft strand is surrounded by a plurality of threads forming the weave of the at least one warp strand.

3. The mesh structure of claim 1 wherein the threads of the at least one warp strand are formed of polypropylene.

4. The mesh structure of claim 1 wherein the at least one warp strand extends along a first path and the at least one weft strand extends along a second path, the first and second paths extending substantially perpendicular to one another.

5. The mesh structure of claim 1 wherein the at least one weft strand is formed of twisted twine.

6. The mesh structure of claim 1 wherein the threads of the at least one warp strand are heat shrunk threads in response to exposure to a predetermined temperature, and the at least one weft strand is substantially impervious to the predetermined temperature.

7. The mesh structure of claim 6 further comprising the at least one weft strand formed of twisted synthetic fibers with at least an outer portion of the twisted synthetic fibers at least partially heat fused with respect to one another in response to the mesh structure being heated to the predetermined temperature.

8. The mesh structure of claim 1 further comprising the at least one warp strand and the at least one weft stand formed of different colors.

9. The mesh structure of claim 1 further comprising the at least one warp stand formed of a darker color material than the at least one weft strand.

10. The mesh structure of claim 1 further comprising:

the at least one weft strand including a first weft strand, a second weft strand, and a third weft strand, the second weft strand passing through the weave of the warp strand a first distance from the first weft strand along a longitudinal axis of the at least one warp strand, and the third weft stand passing through the weave of the at least one warp strand a second distance from the first weft strand along the longitudinal axis of the at least one warp strand, where the first weft strand is positioned between the second and third weft strands along the longitudinal axis of the at least one warp strand and the first distance is greater than the second distance.

11. A mesh structure comprising:

a plurality of warp strands, each warp strand formed with heat shrinkable threads woven to define a weave; and a plurality of weft strands, each weft stand piercingly passing through the weave of each warp stand and immovably associated with the heat shrunk threads of each warp strand.

12. The mesh structure of claim 11 further comprising each weft stand positioned substantially perpendicular to each warp strand.

13. The mesh structure of claim 11 further comprising the plurality of weft strands arranged in closely spaced pairs of weft strands, where the pairs of weft strands are spaced fiber from adjacent pairs of weft stands than the weft strands forming each pair are spaced from one another.

14. The mesh structure of claim 11 further comprising the plurality of warp strands and the plurality of weft stands having different colors with respect to one another.

15. The mesh structure of claim 11 further comprising the heat stable threads of the plurality of warp strands constricting tightly around the weft strands piercing therethrough in response to being heated to a predetermined temperature, and the plurality of weft strands substantially impervious to being heated to the predetermined temperature.

16. A mesh structure comprising:

a warp strand formed of heat shrinkable material woven into a weave; and a weft strand passing through the weave of the warp strand, the material of the weave heat shrunk and constricted around the weft strand to immovably associate the warp strand with the weft strand piercingly engaged through the weave of the warp strand.

17. The mesh structure of claim 16 further comprising the heat shrinkable material of the warp strand formed of polypropylene.

18. The mesh structure of claim 16 further comprising the warp strand and the weft strand extending subs any perpendicular to one another.

19. The mesh structure of claim 16 further comprising the heat shrinkable material of the warp strand responsive to being exposed to a predetermined temperature, and the weft strand being substantially impervious to the predetermined temperature.

20. The mesh structure of claim 16 further comprising the heat shrinkable material of the warp strand responsive to being exposed to a predetermined temperature, and the weft strand formed of twisted synthetic fibers with at least an outer portion partially heat fused with respect to one another in response to being heated to the predetermined temperature.

* * * * *